US007328663B2

(12) United States Patent
Leng

(10) Patent No.: US 7,328,663 B2
(45) Date of Patent: Feb. 12, 2008

(54) TABLE TOP

(75) Inventor: Lu Hao Leng, Xiamen (CN)

(73) Assignee: Cosco Management, Inc., Wilmington, DE (US)

( * ) Notice: Subject to any disclaimer, the term of this patent is extended or adjusted under 35 U.S.C. 154(b) by 242 days.

(21) Appl. No.: 11/000,704

(22) Filed: Dec. 1, 2004

(65) Prior Publication Data

US 2005/0223951 A1 Oct. 13, 2005

(51) Int. Cl.
*A47B 13/00* (2006.01)

(52) U.S. Cl. ..... 108/157.14; 108/161; 108/27

(58) Field of Classification Search ..... 108/165, 108/27, 152.14, 51.3, 161; 748/188.1, 188
See application file for complete search history.

(56) References Cited

U.S. PATENT DOCUMENTS 2,876,053 A * 3/1959 Eves ..... 108/27
4,558,553 A * 12/1985 Kolk ..... 108/27
4,805,541 A * 2/1989 Drane et al. ..... 108/27
4,899,967 A * 2/1990 Johnson ..... 248/97
4,962,709 A * 10/1990 Huber ..... 108/44
5,404,828 A * 4/1995 Tesney ..... 108/27
5,623,882 A * 4/1997 Price ..... 108/129
5,634,411 A * 6/1997 Chasan ..... 108/153.1
5,694,865 A * 12/1997 Raab ..... 108/161
5,947,037 A * 9/1999 Hornberger et al. ..... 108/115
6,006,679 A * 12/1999 Lin ..... 108/157.15
6,123,031 A * 9/2000 Hayman-Chaffey ..... 108/27
6,222,107 B1 * 4/2001 Lo ..... 248/188
6,227,515 B1 * 5/2001 Broyles ..... 248/678
6,837,171 B1 * 1/2005 Clark et al. ..... 108/161
7,059,255 B2 * 6/2006 Tsai ..... 108/161

* cited by examiner

*Primary Examiner*—Jose V. Chen
(74) *Attorney, Agent, or Firm*—Barnes & Thornburg LLP

(57) ABSTRACT

A table top includes an exterior shell providing an interior region. An interior frame and a core are located in the interior region. The exterior shell includes top and bottom sheets and a perimeter bumper.

19 Claims, 2 Drawing Sheets

TABLE TOP

This application claims priority under 35 U.S.C. § 120 to U.S. patent application Ser. No. 10/824,215, filed Apr. 14, 2004, which is expressly incorporated by reference herein.

BACKGROUND

The present disclosure relates to a table and, in particular, to a table top. More particularly, the present disclosure relates to multi-component table tops.

SUMMARY

A table top includes an exterior shell, an interior frame in an interior region defined by the exterior shell, and a core surrounded by the interior frame. The interior frame includes a rail and blocks coupled to the rail.

In an illustrative embodiment of the disclosure, four side blocks are coupled to a circular rail to provide an interior frame surrounding a cellular core. During assembly of the components to produce this table top, a curved rail with two opposed ends is provided and four side blocks are coupled to the curved rail to lie adjacent to the cellular core in an interior space bounded by the curved rail. The two opposed ends are coupled to produce an "endless" circular rail carrying four spaced-apart side blocks.

The cellular core is then placed in an interior space defined by the interior frame and the exterior shell is coupled to the interior frame to produce the table top. A table top support frame is arranged to underlie the exterior shell and is anchored using suitable fasteners to the four side blocks located in the interior region of the exterior shell.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the following figures in which.

DETAILED DESCRIPTION

Figure 1:
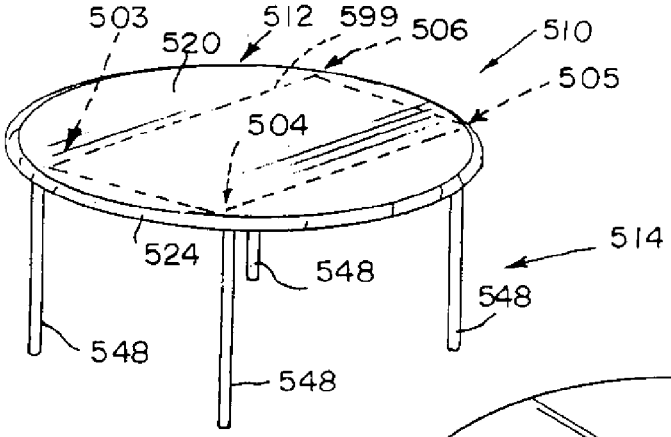
FIG. 1 is a perspective view of a table including a table top in accordance with the present disclosure.
Figure 2:
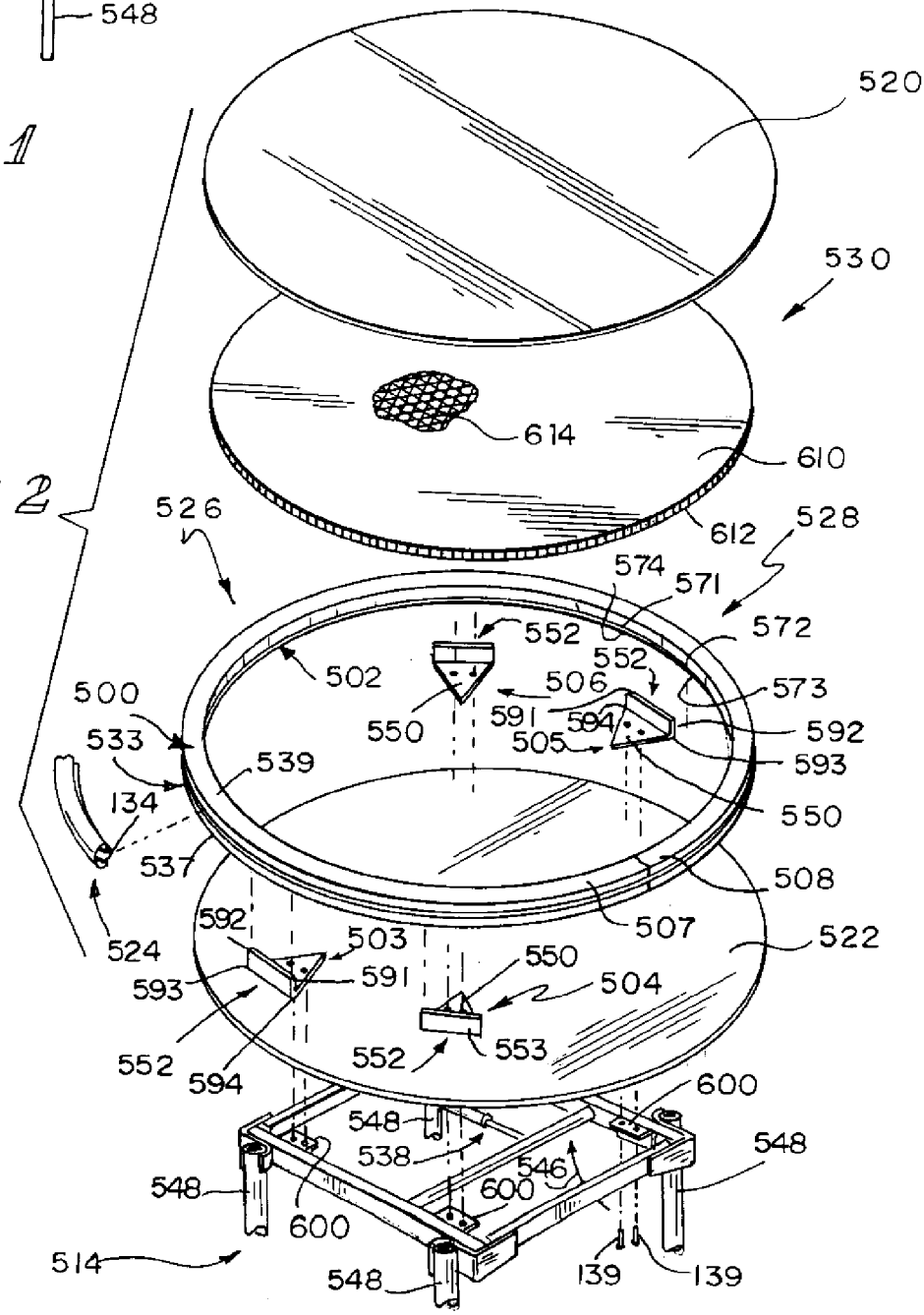
FIG. 2 is an exploded perspective view of the table of FIG. 1 showing, from top to bottom, a top sheet, a cellular core, an interior frame comprising a curved rail and four "pie-shaped" side blocks adapted to be coupled to the curved rail, a bottom sheet, a portion of a circular perimeter bumper that is configured to cooperate with the top and bottom sheets to form an exterior shell containing the cellular core and the interior frame, and an exterior table top support frame underlying the bottom sheet of the table top.

A round table 510 in accordance with the disclosure is illustrated in FIG. 1 and includes a table top 512 and a table top support frame 514. As shown in FIGS. 1 and 2, table top 512 includes an exterior shell 518 including a top sheet 520, a bottom sheet 522, and a perimeter bumper 524. These components cooperate to form an interior region 526 containing an interior frame 528 and a core 530 when assembled, for example, as suggested in FIGS. 3 and 4. In the illustrated embodiment, interior frame 528 includes circular rail 500 and four side blocks 503, 504, 505, 506 coupled to circular rail 500.

Interior frame 528 includes circular rail 500 and in series first, second, third, and fourth side blocks 503, 504, 505, 506 coupled to circular rail 500 as suggested in FIG. 2. Once assembled, side blocks 503, 504, 505, 506 are arranged to lie in circumferentially spaced-apart relation about circular rail 500 as suggested in FIG. 2. Once the blocks are coupled to circular rail 500, first and second ends 507, 508 of circular rail 500 can be coupled to one another to form an endless loop. In the illustrated embodiment, each of blocks 503, 504, 505, and 506 have the same size and shape.

Once assembled, first, second, third, and fourth side blocks 503, 504, 505, 506 are arranged to lie in spaced-apart relation to one another about circular rail 500 to form "corners" of a "reference rectangle" 599 inscribed in circular rail 500 as suggested in FIG. 1. Each side block 503, 504, 505, 506 includes fastener receiver means 137 for receiving a fastener 139 arranged to couple table top support frame 514 to bottom sheet 522 so that table top frame 514 is anchored in a fixed position on bottom sheet 522.

Figure 4:
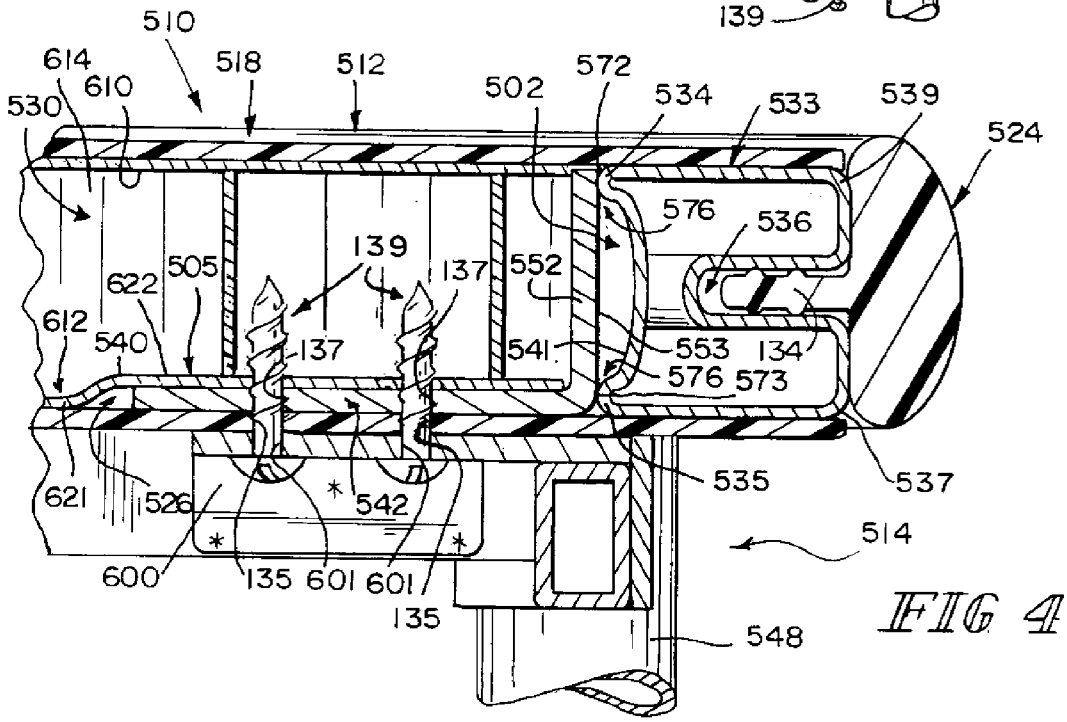
FIG. 4 is an enlarged sectional view taken along line 4-4 of FIG. 3 showing portions of the exterior table top support frame mounted on an underside of the table top and coupled by fasteners to a fastener plate included in one of the pie-shaped side blocks included in the table top.

Circular rail 500 includes a base 533 coupled to perimeter bumper 524 and curved top and bottom rims 534, 535 provided on base 533 as shown, for example, in FIG. 4. Side blocks 503, 504, 505, and 506 are coupled (e.g., welded) to top and bottom rims 534, 535 of circular rail 500 during assembly of interior frame 528 and preparatory to insertion of cellular core 530 in interior region 526 of exterior shell 518.

Figure 3:
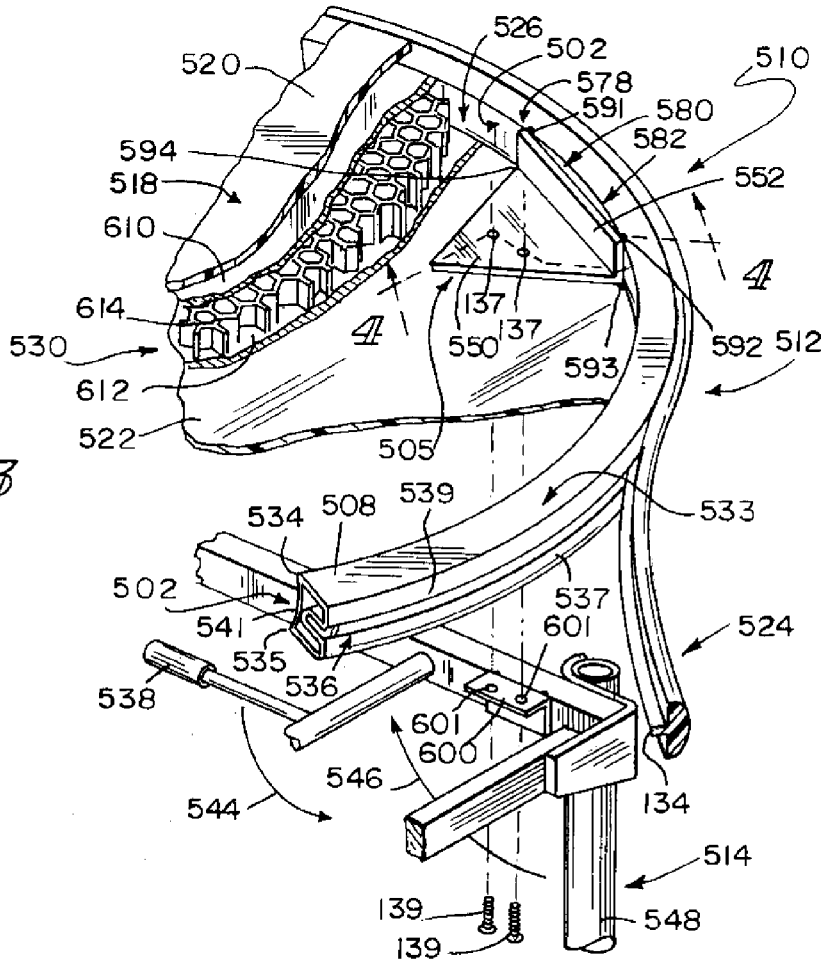
FIG. 3 is an enlarged perspective view of portions of the table of FIG. 1, with portions broken away, showing the cellular core located in an interior region defined by the exterior shell, a pie-shaped first side block coupled to the circular rail, and coupling of a portion of the perimeter bumper to the circular rail and showing that the first side block comprises a mount plate welded to the circular rail at four contact points and a fastener plate cantilevered to a lower portion of the mount plate.

Base 533 of circular rail 500 includes radially outwardly extending curved lower and upper strips 537, 539 as shown in FIGS. 2 and 3. Curved lower strip 537 is arranged to lie in spaced-apart relation to curved upper strip 539 to provide therebetween an elongated curved channel 536 as shown in FIG. 4. Curved channel 536 is sized and shaped to receive a portion 134 of the perimeter bumper 524 therein to retain perimeter bumper 524 in a fixed position on circular rail 500 as also shown in FIG. 4.

During assembly of the components to produce table top 512, a curved rail 500 with two opposed ends 507, 508 is provided and four side blocks 503, 504, 505, 506 are coupled to curved rail 500 to assume circumferentially spaced-apart positions as suggested in FIG. 2. The two opposed ends 507, 508 are coupled to produce an "endless" circular rail carrying four spaced-apart side blocks as suggested in FIG. 4. Perimeter bumper 524 is coupled to circular rail 500. Top and bottom sheets 520, 522 are coupled to one or more of circular rail 500 and core 530 to retain core 530 in interior region 526 of exterior shell 518. Table top support frame 514 is then arranged to underlie exterior shell 518 and is anchored using suitable fasteners 139 arranged to extend into fastener receivers 135 formed in bottom sheet 522 and into fastener receivers 137 formed in side blocks 503, 504, 505, 506 located in interior region 526 of exterior shell 18.

As suggested, for example, in FIGS. 3 and 4, table top 512 includes top sheet 520, bottom sheet 522, cellular core 530, and perimeter rail 500. Bottom sheet 522 underlies top sheet 520 to define an interior region 526 containing cellular core 530. Perimeter rail 500 is arranged to surround cellular core 530 and is coupled to top and bottom sheets 520, 522 using an adhesive or other suitable fastener. In the illustrated embodiment, each of top and bottom sheets 520, 522, core 530, and perimeter rail 500 is round. It is within the scope of this disclosure to employ any suitable non-round shapes for these components to produce a rectangle-shaped or oval-shaped table top.

Perimeter rail 500 includes a side wall 502 located in interior region 526 and arranged to face radially inwardly toward cellular core 530 as shown, for example, in FIGS. 3 and 4. Side blocks 503, 504, 505, and 506 are coupled to side wall 502 to establish fixed positions of those side blocks in interior region 526 of table top 512.

It is within the scope of this disclosure to use any suitable support structure to elevate table top 512. Such a structure will include fasteners adapted to be coupled to side blocks 503, 504, 505, and 506 to anchor the support structure in a fixed position relative to table top 512.

In the illustrated embodiment, table top support frame 514 includes fasteners 139 adapted to be coupled to bottom sheet 522 and side blocks 503, 504, 505, 506 and to extend into cellular core 530. Reference is hereby made to U.S. patent application Ser. No. 10/376,825 for a description of a suitable table top support frame, which description is incorporated by reference herein.

Table top support frame 514 includes a locking handle 538 and a plurality of legs 548. Upon movement of locking handle 538 in direction 544, as shown in FIG. 3, each leg 548 is able to move from an opened position perpendicular to and supporting table 510 to a closed position in direction 546 where leg 548 is folded under and generally parallel to bottom sheet 522.

Table top support frame 514 further includes four fastener brackets 600, each fastener bracket 600 being associated with one of the side blocks 503, 504, 505, and 506. Each bracket 600 is formed to include apertures 601 or other suitable means for receiving fasteners 139 shown, for example, in FIG. 4, so that fasteners 139 can be coupled to companion brackets 600 and side blocks 503, 504, 505, and 506 to anchor table top 512 to table top support frame 514.

Each of side blocks 503, 504, 505, and 506 includes a fastener plate 550 and a mount plate 552 coupled to fastener plate 550 as suggested in FIG. 2. Fastener plate 550 is coupled to fasteners 139 to anchor table top 512 to table top support frame 514. Mount plate 552 is coupled to side wall 502 of perimeter rail 500 in the illustrated embodiment to anchor fastener plate 550 in a fixed position in interior region 526 of table top 512. In the illustrated embodiment, fasteners 139 pass through fastener receivers 135 formed in bottom sheet 522 and fastener receivers 137 formed in fastener plate 550.

As shown best in FIGS. 3 and 4, side wall 502 of perimeter rail 500 includes a top rim 534 arranged to lie adjacent to top sheet 520 and a bottom rim 535 arranged to lie adjacent to bottom sheet 522 and in spaced-apart relation to top rim 534. In the illustrated embodiment, side wall 502 of perimeter rail 500 further includes a concave surface 541 arranged to interconnect top and bottom rims 534, 535 and face toward cellular core 530. In the illustrated embodiment, each of top and bottom rims 534, 535 and concave surface 541 is curved as suggested, for example, in FIGS. 3 and 4.

Mount plate 552 of each side block 503, 504, 505, and 506 is coupled to top and bottom rims 534, 535. In the illustrated embodiment, mount plate 552 has a rectangular shape and is coupled to curved top and bottom rims 534, 535 to extend along a chord of each of the top and bottom rims 534, 535.

As suggested in FIGS. 2 and 3, an upper portion of mount plate 552 is coupled to curved top rim 534 at spaced-apart first and second contact points 571, 572 using any suitable fastening material such as weldment. A spot welding technique is used in the illustrated embodiment.

Each mount plate 552 includes four corner portions 591, 592, 593, and 594 as shown in FIG. 2. Illustratively, first corner portion 591 of mount plate 552 is coupled to top rim 534 at first contact point 571 and second corner portion 592 of mount plate 552 is coupled to top rim 534 at second contact-point 572. A lower portion of mount plate 552 is coupled to curved bottom rim 535 at spaced-apart third and fourth contact points 573, 574 again using any suitable fastening material. Illustratively, third corner portion 593 of mount plate 552 is coupled to bottom rim 535 at third contact point 573 and fourth corner portion 594 of mount plate 552 is coupled to bottom rim 535 at fourth contact point 574.

In the illustrated embodiment, fastener plate 550 of each side block 503, 504, 505, and 506 has a triangular shape to provide the side blocks with a somewhat "pie-shaped" appearance as suggested in FIGS. 2 and 3. One embodiment of fastener plate 550 is an Isosceles right triangle arranged so that a hypotenuse thereof is appended to a bottom portion of mount plate 552. As suggested in FIG. 4, side block 505 is L-shaped in cross section.

As suggested in FIGS. 3 and 4, mount plate 552 includes a flat surface 553 providing corner portions 591, 592, 593, and 594. Flat surface 553 faces toward concave surface 541 of radially inwardly facing side wall 502 of perimeter rail 500 as shown best in FIG. 4. Flat surface 553 includes an upper straight chordal portion interconnecting first and second corner portions 591, 592 and lying in spaced-apart relation to an arc-shaped portion of curved top rim 534 located between first and second contact points 571, 572 to define a D-shaped opening therebetween as suggested in FIG. 3. Flat surface 553 further includes a lower straight chordal section interconnecting third and fourth corner portions 593, 594 and lying in spaced-apart relation to an arc-shaped portion of curved bottom rim 535 located between third and fourth contact points 593, 594 to define a D-shaped opening therebetween.

Cellular core 530 includes a top face 610, a bottom face 612, and a honeycomb 614 located between top and bottom faces 610, 612 as suggested in FIG. 3. When components are assembled to produce table top 512, portions of cellular core 530 adjacent to fastener plates 550 will be compressed in the illustrated embodiment as shown, for example, in FIG. 4. Bottom face 612 of cellular core 530 has a first portion 621 lying in a first plane and engaging bottom sheet 522 and a second portion 622 lying in a second plane located in spaced-apart relation to bottom sheet 522 and engaging an upwardly facing surface of fastener plate 550 facing toward top sheet 520. When assembled, as suggested in FIG. 4, a cross-sectional height of second portion 622 of cellular core 530 positioned to lie adjacent to fastener plate 550 is about equal to a cross-sectional height of first portion 621 of cellular core 530 minus a cross-sectional height of fastener plate 550.

In some embodiments contemplated by this disclosure, upright mount plate 552 is formed to include an arc portion arranged to lie flush against radially inwardly facing portions of circular rail 500 to couple upright mount plate 552 to circular rail 500. While the illustrative embodiment contemplates the use of spot welding to couple upright mount portion 569 to radially inwardly facing circular rail 500, any suitable fastening material is also contemplated.

The invention claimed is:

1. A table comprising a table top including a top sheet and a bottom sheet underlying the top sheet to define an interior region therebetween, a cellular core located in the interior region and arranged to lie between the top and bottom sheets, a perimeter rail arranged to surround the cellular core and coupled to the top and bottom sheets, the perimeter rail including a side wall located in the interior region and arranged to face toward the cellular core, a table top support frame arranged to underlie the bottom sheet, the table top support frame including a frame unit and a fastener coupled to the frame unit, a first side block located in the interior region, the first side block including a fastener plate coupled to the fastener to anchor the table top to the table top support frame, the first side block further including a mount plate appended to the fastener plate and interposed between the cellular core and a curved portion of the perimeter rail, the mount plate being coupled to the side wall of the curved portion of the perimeter rail to anchor the fastener plate in a fixed position in the interior region, wherein the side wall of the perimeter rail includes a top rim arranged to lie adjacent to the top sheet and a bottom rim arranged to lie adjacent to the bottom sheet and in spaced-apart relation to the top rim and wherein the mount plate is coupled to the top and bottom rims, wherein the side wall of the perimeter rail further includes a concave surface arranged to interconnect the top and bottom rims and face toward the cellular core, and wherein each of the top and bottom rims and the concave surface is curved and the mount plate has a rectangular shape and is coupled to the curved top and bottom rims of the perimeter rail to extend along a chord of each of the curved top and bottom rims.

2. A table comprising a table top including a top sheet and a bottom sheet underlying the top sheet to define an interior region therebetween, a cellular core located in the interior region and arranged to lie between the top and bottom sheets, a perimeter rail arranged to surround the cellular core and coupled to the top and bottom sheets, the perimeter rail including a side wall located in the interior region and arranged to face toward the cellular core, a table top support frame arranged to underlie the bottom sheet, the table top support frame including a frame unit and a fastener coupled to the frame unit, a first side block located in the interior region, the first side block including a fastener plate coupled to the fastener to anchor the table top to the table top support frame, the first side block further including a mount plate appended to the fastener plate and interposed between the cellular core and a curved portion of the perimeter rail, the mount plate being coupled to the side wall of the curved portion of the perimeter rail to anchor the fastener plate in a fixed position in the interior region, wherein the side wall of the perimeter rail includes a top rim arranged to lie adjacent to the top sheet and a bottom rim arranged to lie adjacent to the bottom sheet and in spaced-apart relation to the top rim and wherein the mount plate is coupled to the top and bottom rims, and wherein the top rim is curved and the mount plate is coupled to the curved top rim at spaced-apart first and second contact points to extend along a chord of the curved top rim.

3. The table of claim 2, wherein the bottom rim is curved and the mount plate is coupled to the curved bottom rim at spaced-apart first and second contact points to extend along a chord of the curved bottom rim.

4. The table of claim 2, wherein the mount plate is flat and has a rectangular shape.

5. A table comprising a table top including a top sheet and a bottom sheet underlying the top sheet to define an interior region therebetween, a cellular core located in the interior region and arranged to lie between the top and bottom sheets, a perimeter rail arranged to surround the cellular core and coupled to the top and bottom sheets, the perimeter rail including a side wall located in the interior region and arranged to face toward the cellular core, a table top support frame arranged to underlie the bottom sheet, the table top support frame including a frame unit and a fastener coupled to the frame unit, a first side block located in the interior region, the first side block including a fastener plate coupled to the fastener to anchor the table top to the table top support frame, the first side block further including a mount plate appended to the fastener plate and interposed between the cellular core and a curved portion of the perimeter rail, the mount plate being coupled to the side wall of the curved portion of the perimeter rail to anchor the fastener plate in a fixed position in the interior region, wherein the side wall of the perimeter rail includes a top rim arranged to lie adjacent to the top sheet and a bottom rim arranged to lie adjacent to the bottom sheet and in spaced-apart relation to the top rim and wherein the mount plate is coupled to the top and bottom rims, and wherein the bottom rim is curved and the mount plate is coupled to the curved bottom rim at spaced-apart first and second contact points to extend along a chord of the curved bottom rim.

6. The table of claim 5, wherein the mount plate is flat and has a rectangular shape.

7. The table of claim 5, wherein the fastener plate has a triangular shape and is formed to include a fastener receiver and the fastener is arranged to extend through the fastener receiver.

8. The table of claim 5, wherein the bottom sheet is formed to include a fastener receiver, the fastener plate is formed to include a fastener receiver in alignment with the fastener receiver in the bottom sheet, and the fastener extends into the fastener receivers in the bottom sheet and the fastener plate to anchor the table top support frame to the bottom sheet and the fastener plate.

9. The table of claim 8, wherein the fastener plate is interposed between the cellular core and the bottom sheet.

10. The table of claim 9, wherein the cellular core includes a bottom face having a first portion lying in a first plan and engaging the bottom sheet and a second portion lying in a second plane located in spaced-apart relation to the bottom sheet and engaging a surface of the fastener plate facing toward the top sheet and the fastener extends into the second portion of the cellular core.

11. The table of claim 5, wherein the fastener plate is interposed between the cellular core and the bottom sheet.

12. The table of claim 11, wherein the cellular core includes a bottom face having a first portion lying in a first plane and engaging the bottom sheet and a second portion lying in a second plane located in spaced-apart relation to the bottom sheet and engaging a surface of the fastener plate facing toward the top sheet.

13. The table of claim 5, wherein the mount plate is arranged to lie at about a right angle to the fastener plate.

14. The table of claim 5, wherein the fastener plate forms an Isosceles right triangle arranged so that a hypotenuse thereof is appended to the bottom portion of the upright mount plate adjacent to the lower rim of the circular rail.

15. The table of claim 14, wherein the fastener plate is formed to include a plurality of fastener receivers configured to receive one of the fasteners coupled to the table top support frame.

16. The table of claim 5, wherein a cross-sectional height of the cellular core adjacent to the fastener plate is about equal to a cross-sectional height of the cellular core minus a cross-sectional height of the fastener plate.

17. A table comprising a table top including a top sheet and a bottom sheet underlying the top sheet to define an interior region therebetween, a cellular core located in the interior region and arranged to lie between the top and bottom sheets, a perimeter rail arranged to surround the cellular core and coupled to the top and bottom sheets, the perimeter rail including a side wall located in the interior region and arranged to face toward the cellular core, a table top support frame arranged to underlie the bottom sheet, the table top support frame including a frame unit and a fastener coupled to the frame unit, and a first side block located in the interior region, the first side block including a fastener plate coupled to the fastener to anchor the table top to the table top support frame, the first side block further including a mount plate appended to the fastener plate and interposed between the cellular core and the perimeter rail, the mount plate being coupled to the side wall of the perimeter rail to anchor the fastener plate in a fixed position in the interior region wherein the rail is circular and includes a curved top rim and a curved bottom rim, the mount plate includes four corner portions, and a first and second of the corner portions are coupled to the curved top rim at first and second contact points, respectively, and a third and fourth of the corner portions are coupled to the curved bottom rim at third and fourth contact points, respectively, such that the mount plate is spaced from the top rim and bottom rim except at the contact points.

18. The table of claim 17, wherein the fastener plate forms an Isosceles right triangle with a hypotenuse thereof appended to a bottom portion of the upright mount plate.

19. A table comprising a table top including a top sheet and a bottom sheet underlying the top sheet to define an interior region therebetween, a cellular core located in the interior region and arranged to lie between the top and bottom sheets, a perimeter rail arranged to surround the cellular core and coupled to the top and bottom sheets, the perimeter rail including a side wall located in the interior region and arranged to face toward the cellular core, a table top support frame arranged to underlie the bottom sheet, the table top support frame including a frame unit and a fastener coupled to the frame unit, and a first side block located in the interior region, the first side block including a fastener plate coupled to the fastener to anchor the table top to the table top support frame, the first side block further including a mount plate appended to the fastener plate and interposed between the cellular core and the perimeter rail, the mount plate being coupled to the side wall of the perimeter rail to anchor the fastener plate in a fixed position in the interior region wherein the rail is circular and includes a curved top rim and a curved bottom rim, the mount plate includes four corner portions, and a first and second of the corner portions are coupled to the curved top rim at first and second contact points, respectively, and a third and fourth of the corner portions are coupled to the curved bottom rim at third and fourth contact points, respectively wherein the mount plate includes a flat surface providing the corner portions and facing toward the circular rail, the flat surface includes an upper straight chordal section interconnecting the first and second of the corner portions and lying in spaced-apart relation to an arc-shaped portion of the curved top rim located between the first and second contact points to define a D-shaped opening therebetween, and the flat surface further includes a lower straight chordal section interconnecting the third and fourth of the corner portions and lying in spaced-apart relation to an arc-shaped portion of the curved bottom rim located between the third and fourth contact points to define a D-shaped opening therebetween.

* * * * *